US006061941A

United States Patent [19]

Verret

[11] Patent Number: 6,061,941

[45] Date of Patent: May 16, 2000

[54] FLEX HOLDER FOR FLEXIBLE FACE SIGN

[76] Inventor: Normand Verret, 745 Rue Canada, Edmundston, New Brunswick, Canada, E3V 1W3

[21] Appl. No.: 09/139,405

[22] Filed: Aug. 25, 1998

[51] Int. Cl.[7] ..... G09F 17/00

[52] U.S. Cl. ..... 40/603; 160/327; 160/371

[58] Field of Search ..... 40/603, 648, 653; 38/102.91, 102.1; 160/378, 371, 380, 327, 328; 24/18, 587, 716

[56] References Cited

U.S. PATENT DOCUMENTS

| | | | |
|---|---|---|---|
| 1,392,123 | 9/1921 | Danisi | 38/102.5 |
| 1,411,908 | 4/1922 | Cacici | 38/102.91 |
| 2,266,466 | 12/1941 | Linder | 160/378 |
| 3,338,285 | 8/1967 | Jaster | 24/587 X |
| 4,189,880 | 2/1980 | Ballin | 160/380 X |
| 4,778,282 | 10/1988 | Borchardt et al. | 24/587 X |
| 5,255,459 | 10/1993 | Verret . | |
| 5,577,305 | 11/1996 | Johnson | 24/587 |
| 5,669,166 | 9/1997 | Verret . | |

*Primary Examiner*—Joanne Silbermann
*Attorney, Agent, or Firm*—Mario D. Theriault

[57] ABSTRACT

A flex holder for retaining a flexible sign face material to a sign casing. The flex holder comprises a body having a longitudinal axis and a hinge extending along the longitudinal axis. An elongated tongue is connected to the hinge and a groove is formed in the body along a projection of the tongue about the hinge. The tongue has a pair of notches therein such that when the tongue is bent over a flexible sign face material and engaged in the groove, the flexible face material is held transversely to the body by an engagement of the tongue and groove and is held longitudinally to the body by a friction of the flexible sign face material between the notches and the groove.

20 Claims, 2 Drawing Sheets

FLEX HOLDER FOR FLEXIBLE FACE SIGN

FIELD OF THE INVENTION

This invention pertains to flex holders for retaining flexible face material to a sign frame and more particularly, it pertains to a flex holder having gripping capabilities in transversal and longitudinal directions.

BACKGROUND OF THE INVENTION

Flexible face signs of the type related to the present invention have their face material stretched across an opening in a sign frame and anchored to the periphery of the sign's opening. Holding devices are attached at intervals along the face material and are generally made to engage into a slot along the sign frame to affix the face material to the sign casing. The holding devices and the slot are covered with a cap or molding that enhances the general appearance of the sign.

Examples of flex holders of the prior art are disclosed in U.S. Pat. No. 5,255,459 issued on Oct. 26, 1993, and in U.S. Pat. No. 5,669,166, issued on Sep. 23, 1997, both to Normand Verret, the inventor of the present invention. In the latter case, the flex holders are made of aluminum and have longitudinal tongue and groove arrangement which is pressed over the face material to squeeze and grip the face material between the tongue and the groove. Several flex holders are installed along the edge of the flexible face material, and are inserted into a serrated slot along the sign casing for adjustably stretching the face material over the sign's opening and for retaining the face material in a taut condition.

A typical inconvenience with the flex holders of the latter case is that they have a tendency to slip along the edge of the flexible sign face material when struck sideways. Therefore, it becomes difficult to remove wrinkles in a face material during the deployment and installation of the flexible sign face material.

SUMMARY OF THE INVENTION

In the present invention, however, there is provided a flex holder that has a tongue and groove arrangement and notches in the tongue thereof for retaining the flexible sign face material in transversal and longitudinal directions relative to the edge of the flexible sign face material.

In accordance with a first aspect of the present invention, there is provided a flex holder for retaining a flexible sign face material to a sign casing. The flex holder comprises a body having a longitudinal axis and a hinge extending along the longitudinal axis. An elongated tongue is connected to the hinge, and a groove is formed in the body along a projection of the tongue about the hinge.

The tongue has a pair of notches therein such that when the tongue is bent over a flexible sign face material and engaged in the groove, the flexible sign face material is held transversely relative to the body by an engagement of the tongue and groove and is held longitudinally relative to the body by a friction of the flexible sign face material between the notches and the groove.

The flex holder can thereby be pushed sideways in the serrated slot of a sign casing without slipping on the flexible sign face material. The flex holder can thereby be pushed sideways for tightening the flexible sign face along the length of the sign casing and for removing any wrinkles that may be present in the flexible sign face material.

In accordance with another aspect of the present invention, the flex holder has a longitudinal abutment member for prying against a flexible sign face material. The abutment member has rounded corners and rounded edges between the rounded corners such that when the tongue is bent over a flexible sign face material and engaged in the groove, the flexible face material is held transversely to the body by an engagement of the tongue and the groove, and the rounded corners and rounded edges reduce a concentration of forces applied against the flexible sign face material. This feature is particularly advantageous when the sign is installed in regions of high winds where the flexible sign face material is exposed to severe stresses. This feature prevents the tearing of the flexible sign face material in regions of high stresses along the flex holders.

BRIEF DESCRIPTION OF THE DRAWINGS

The preferred embodiment of the invention will be further understood from the following description, with reference to the drawings in which.

DETAILED DESCRIPTION OF THE PREFERRED EMBODIMENT

Figure 1:
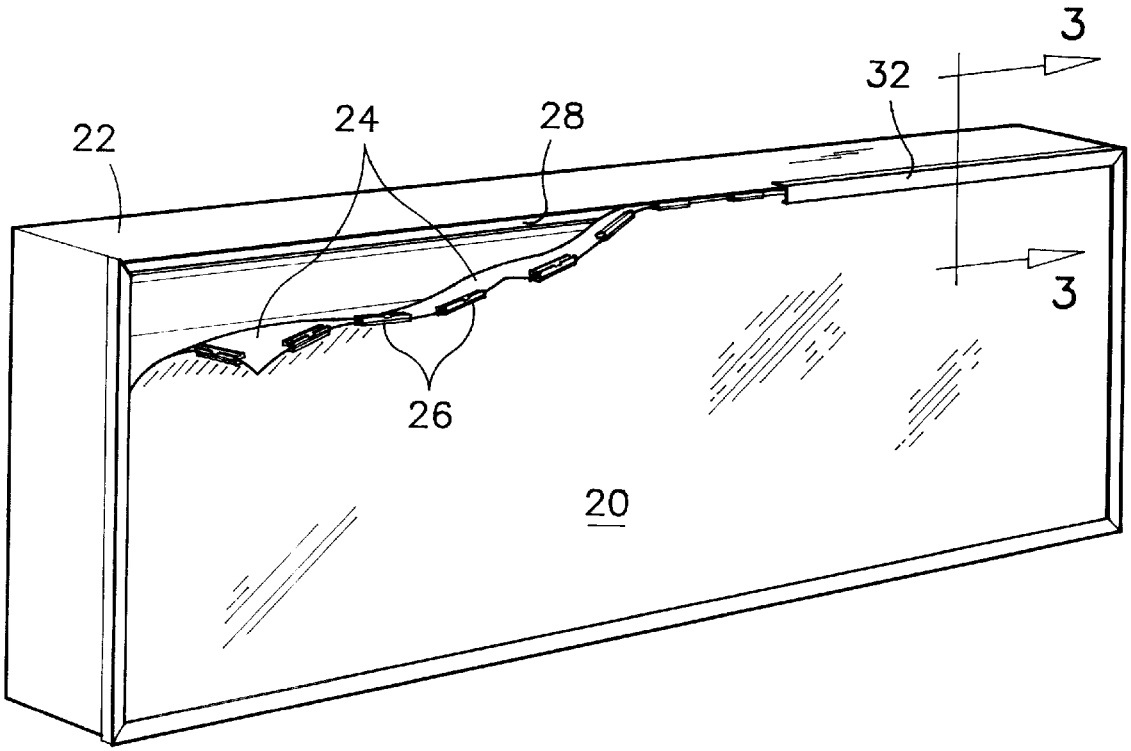
FIG. 1 illustrates a rectangular sign of the type related to the present invention.
Figure 2:
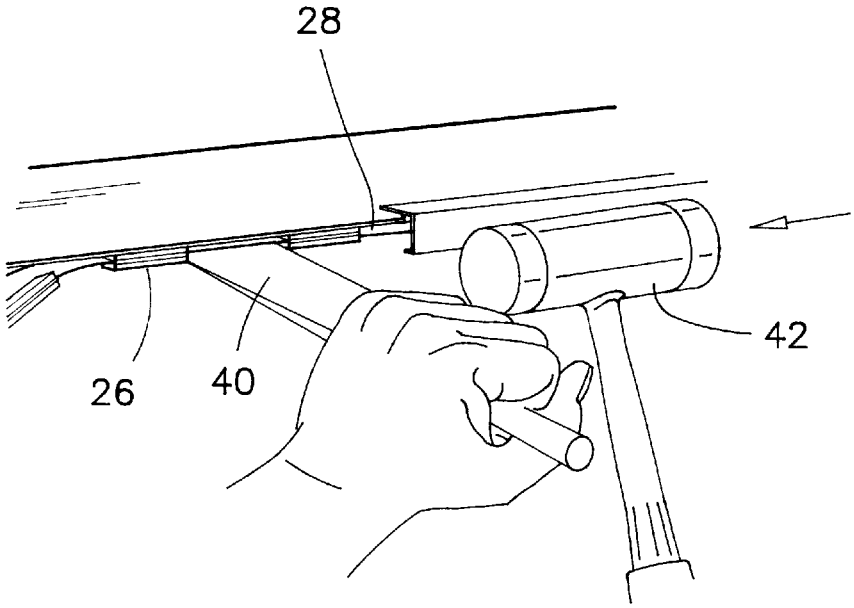
FIG. 2 illustrates a typical method for removing transversal wrinkles in a flexible face sign.
Figure 3:
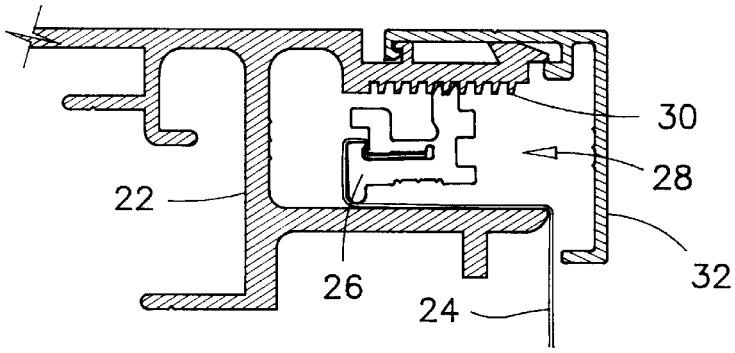
FIG. 3 is a partial cross-section of a sign casing as viewed along line 3—3 in FIG.1, and illustrating the installation of a flex holder into the serrated slot of the casing.
Figure 4:
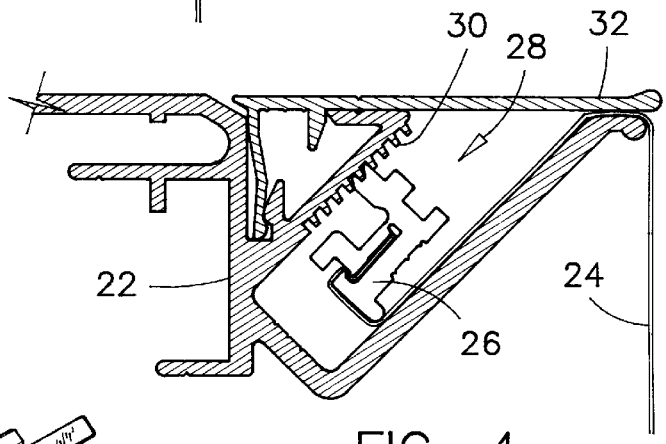
FIG. 4 is a partial cross-section of a frameless sign casing wherein the flex holder of the present invention is also usable.

Referring to FIG. 1–3, the sign 20 of interest herein has a rectangular casing 22 defining a rectangular opening. The flexible face material 24 is held to the casing 22 by a plurality of flex holders 26 installed at spaced intervals along the edge thereof. The flex holders 26 are inserted in a serrated slot 28 and are adjustably movable along the serration 30 to stretch the face material in a transversal direction relative to the edge of the face material, across the opening of the sign. Upon completion of the installation of the flexible sign face, the slot 28 is covered with a decorating edging 32. The casing 22 of the sign may have a serrated slot 28 facing straight forward as illustrated in FIG. 3 or a serrated slot angled toward the exterior of the sign as illustrated in FIG. 4 and referred to in the sign industry as a frameless sign casing.

The flex holder 26 of particular interest herein has an extruded body 26 and a longitudinal axis, and is made of aluminium or other malleable material. It has a longitudinal tongue 34 which is bendable about a hinge member 36 connected to the body, to engage into a longitudinal groove 38. When a flex holder 26 is closed over the edge of a flexible sign face material, the material is squeezed and gripped between the tongue 34 and the groove 38.

In many sign installations and in longer signs in particular, there may be wrinkles in the flexible sign face material. These wrinkles are due to the fact that a sign face is normally delivered to a job site in a rolled up form, and is installed while workers stand on ladders, scaffolding or in crane baskets. The installation conditions are therefore not always ideal and the flex holders are not always equally spaced apart and evenly inserted in the serrated slot 28. In all cases, these wrinkles must be removed before a sign installation can be considered completed.

A common method for removing wrinkles in a flexible sign face is illustrated in FIG. 2. The method consists of inserting a flat tool 40 in the serrated slot 28, next to a flex holder 26 and to strike the tool 40 with a rubber mallet 42 or a similar tool, for moving the flex holder 26 sideways along the slot 28 to stretch the flexible sign face material in a longitudinal direction relative to the casing. In order to facilitate the longitudinal displacement of the flex holder 28 and the stretching of the flexible sign face material 24 relative to the sign casing, there is provided one or more notches 44 in the tongue 34 of the flex holder 26. Each notch 44 preferably has sharp edges 46 although this is not absolutely necessary. The shape of a notch 44 should not prevent the closing of the tongue 34 into the groove 38 of the flex holder 26.

When the flex holder 26 is closed onto the edge of a flexible sign face material, the flexible sign face material 24 is squeezed between the tongue 34 and the groove 38. The flexible sign face material naturally bulge into the notch 44 thereby providing an interference for gripping against the edges of the notch and for preventing the flex holder from sliding along the flexible sign face material. The flex holder may thereby be pushed sideways along a serrated slot 28 in a sign casing for tightening a sign face material in a longitudinal direction relative to the axis of the serrated slot 28.

Figure 5:
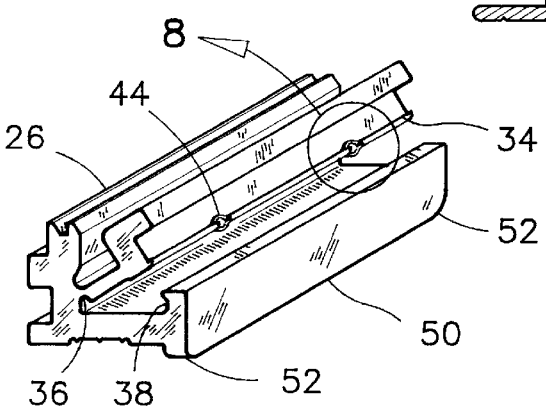
FIG. 5 is a perspective view of a flex holder of the present invention.
Figure 6:
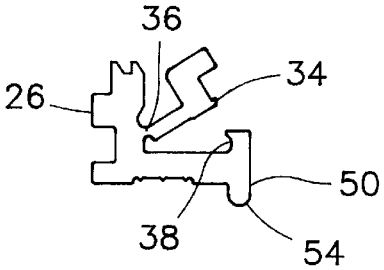
FIG. 6 is a side view of a flex holder of the present invention.
Figure 8:
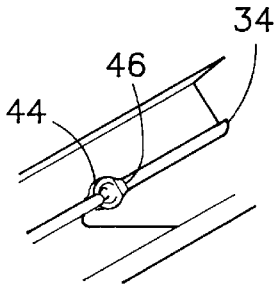
FIG. 8 shows an enlarged perspective view of a concave hollow notch in the tongue of the flex holder of the present invention as shown in detail circle 8 in FIG. 5.
Figure 9:
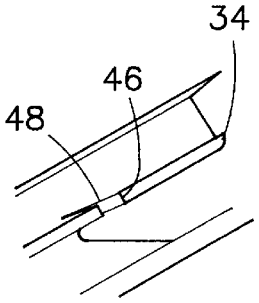
FIG. 9 shows a V-shaped notch in the flex holder of the present invention.

Referring now particularly to FIG. 8 and 9, it will be appreciated that the notch 44 needs not to be a round concave notch as illustrated in FIG. 5 and 8. A square notch or V-shaped notch 48, longitudinal ondulation or other type of deformation in the tongue have been found to be equally appropriate for holding the flexible sign face material with sufficient strength to allow a relatively forceful sideward movement of the flex holder along the serrated slot 28 for stretching the flexible sign face material.

Figure 7:
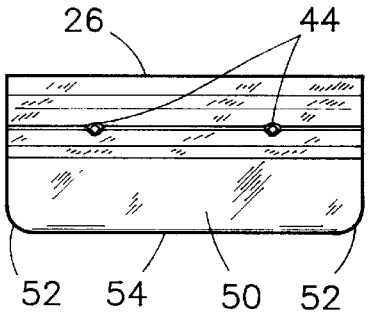
FIG. 7 is a front view of the flex holder of the present invention.

Referring back to FIG. 5 and 7, there is illustrated therein another aspect of the flex holder of the present invention. The segment or abutment 50 of the flex holder used for prying against the flexible face material 24 has rounded corners 52, and a rounded edge 54 between both rounded corners 52. These features have been found to be very important for greatly reducing a concentration of forces and the associated possibilities of tearing the flexible sign face material 24.

While the above description provides a full and complete disclosure of the preferred embodiment of this invention, various modifications, alternate constructions and equivalent may be employed without departing from the true spirit and scope of the invention. Such changes might involve alternate components, structural arrangements, operable features or the like. Therefore, the above description and accompanying illustrations should not be construed as limiting the scope of the invention which is defmed by the appended claims.

I claim:

1. A flex holder for retaining a flexible sign face material to a sign casing, comprising:

a body having a longitudinal axis and a hinge extending along said longitudinal axis;

an elongated tongue connected to said hinge; and a groove formed in said body along a projection of said tongue about said hinge; and said tongue having a notch formed therein across a longitudinal dimension thereof;

such that when said tongue is bent over a flexible sign face material and engaged in said groove, said flexible sign face material is held transversely to said body by an engagement of said tongue in said groove and is held longitudinally to said body by a friction of said flexible sign face material between said notch and said groove.

2. The flex holder as claimed in claim 1, wherein said notch is a transversal deformation in said tongue.

3. The flex holder as claimed in claim 1, wherein said tongue has a a pair of spaced apart notches formed therein.

4. The flex holder as claimed in claim 3, wherein each of said notches has a round concave shape.

5. The flex holder as claimed in claim 3, wherein said notches are V-shaped notches.

6. The flex holder as claimed in claim 3, wherein each of said notches has sharp edges.

7. The flex holder as claimed in claim 1, wherein said body has a longitudinal abutment member for prying against a flexible sign face material and said abutment member has rounded corners.

8. The flex holder as claimed in claim 7, wherein said abutment member has rounded edges between said rounded corners.

9. The flex holder as claimed in claim 1, wherein said body, said hinge and said tongue are integrally formed of aluminum.

10. A flex holder for retaining a flexible sign face material to a sign casing, said flex holder being integrally formed of aluminum and comprising:

a body having a longitudinal axis and a hinge extending along said longitudinal axis;

an elongated tongue connected to said hinge; and a groove formed in said body along a projection of said tongue about said hinge; and said tongue having a pair of spaced apart notches formed therein across a longitudinal dimension thereof;

such that when said tongue is bent over a flexible sign face material and engaged in said groove, said flexible sign face material is held transversely to said body by an engagement of said tongue in said groove and is held longitudinally to said body by a friction of said flexible sign face material between said notches and said groove.

11. The flex holder as claimed in claim 10, wherein each of said notches has a round concave shape.

12. The flex holder as claimed in claim 10, wherein said notches are V-shaped notches.

13. The flex holder as claimed in claim 10, wherein said body has a longitudinal abutment member for prying against a flexible sign face material and said abutment member has rounded corners.

14. The flex holder as claimed in claim 13, wherein said abutment member has rounded edges between said rounded corners.

15. A flex holder for retaining a flexible sign face material to a sign casing, said flex holder being integrally formed of aluminum and comprising:

a body having a longitudinal axis and a hinge extending along said longitudinal axis;

an elongated tongue connected to said hinge; and a groove formed in said body along a projection of said tongue about said hinge;

said body having a longitudinal abutment member for prying against a flexible sign face material and said abutment member having rounded corners;

such that when said tongue is bent over a flexible sign face material and engaged in said groove, said flexible face material is held transversely to said body by an engagement of said tongue in said groove, and a concentration of forces applied by said abutment against said flexible sign face material is relatively small.

16. The flex holder as claimed in claim 15, wherein said abutment member has rounded edges between said rounded corners.

17. The flex holder as claimed in claim 16, wherein said tongue has a pair of spaced apart notches formed therein across a longitudinal dimension thereof, such that when said tongue is bent over a flexible sign face material and is engaged in said groove, said flexible sign face material is held longitudinally to said body by a friction of said flexible sign face material between said notches and said groove.

18. The flex holder as claimed in claim 17, wherein each of said notches has sharp edges.

19. The flex holder as claimed in claim 18, wherein each of said notches has a round concave shape.

20. The flex holder as claimed in claim 18, wherein said notches are V-shaped notches.

* * * * *